US005968432A

United States Patent [19]

Kawai

[11] Patent Number: 5,968,432

[45] **Date of Patent: *Oct. 19, 1999**

[54] PROCESS OF MAKING A FIBER

[75] Inventor: Kigen Kawai, Osaka-fu, Japan

[73] Assignee: Kansai Research Institute (KRI), Osaka, Japan

[ * ] Notice: This patent is subject to a terminal disclaimer.

[21] Appl. No.: 08/811,282

[22] Filed: Mar. 4, 1997

Related U.S. Application Data

[63] Continuation-in-part of application No. 08/718,093, Sep. 11, 1996, abandoned, which is a continuation of application No. 08/195,044, Feb. 9, 1994, abandoned, which is a continuation of application No. 08/103,264, Aug. 9, 1993, abandoned, which is a continuation of application No. 07/758,822, Sep. 12, 1991, Pat. No. 5,234,651.

[51] Int. Cl.[6] ..... D01D 5/06; D01D 5/16

[52] U.S. Cl. ..... 264/184; 264/210.7; 264/210.8; 264/211.15; 264/211.16

[58] Field of Search ..... 264/184, 210.7, 264/210.8, 211.15, 211.16

[56] References Cited

U.S. PATENT DOCUMENTS

| | | | |
|---|---|---|---|
| 3,414,645 | 12/1968 | Morgan, Jr. | 264/184 |
| 3,574,811 | 4/1971 | Jamison | 264/184 |
| 3,767,756 | 10/1973 | Blades | 264/184 |
| 4,263,245 | 4/1981 | Tan | 264/184 |
| 4,342,715 | 8/1982 | Shimada et al. | 264/184 |
| 4,344,908 | 8/1982 | Smith et al. | 264/203 |
| 4,368,615 | 1/1983 | Lammers | 264/184 |
| 4,374,977 | 2/1983 | Fujiwara et al. | 264/184 |
| 4,374,978 | 2/1983 | Fujiwara et al. | 264/184 |
| 4,466,935 | 8/1984 | Bair et al. | 264/184 |
| 4,606,875 | 8/1986 | Chenevey et al. | 264/85 |
| 4,728,473 | 3/1988 | Satoh et al. | 264/184 |
| 4,876,040 | 10/1989 | Park et al. | 264/184 |
| 5,023,035 | 6/1991 | Yang | 264/184 |
| 5,047,500 | 9/1991 | Park et al. | 528/348 |
| 5,234,651 | 8/1993 | Kawai | 264/184 |

FOREIGN PATENT DOCUMENTS

| | | | |
|---|---|---|---|
| 53-065413 | 6/1978 | Japan | 264/184 |

OTHER PUBLICATIONS

*Fibres From Synthetic Polymers*, Rowland Hill, Ed., Aug. 1953, pp. 382–387.

M. Panar, et al., *Morphology Of Poly(p–Pheneylene Terephthalamide)* Fibers.

LI, et al., On The Morphology Of Aromatic Polyamide Fibers (Kevlar, Kevar–49, and PRD–49).

*Primary Examiner*—Leo B. Tentoni

*Attorney, Agent, or Firm*—Jacobson, Price, Holman & Stern, PLLC

[57] ABSTRACT

A process of making a fiber includes the sequential steps of extruding as a stream solution of a polymer having a polymer concentration of 4–24 weight % into a non-coagulating fluid, stretching the stream while in the non-coagulating fluid, passing the stream through a first coagulating bath, stretching the stream in a non-coagulating fluid, and passing the stream through a coagulating bath to sufficiently increase the polymer concentration in the stream to form the fiber.

7 Claims, 10 Drawing Sheets

PROCESS OF MAKING A FIBER

This application is a continuation-in-part of U.S. Ser. No. 08/718,093, filed Sep. 11, 1996, now abandoned which is a continuation of U.S. Ser. No. 08/195,044, filed Feb. 9, 1994, now abandoned which is a continuation of U.S. Ser. No. 08/103,264, filed Aug. 9, 1993, now abandoned, which is a continuation of U.S. Ser. No. 07/758,822, filed Sep, 12, 1991, now U.S. Pat. No. 5,234,651, the disclosures of which are incorporated herein by reference.

The present invention relates to polymer fibers and a method of making the fibers from a solution of the polymer. More particularly, the present invention related to improvements in the method of making polymer fibers known as "dry-jet wet spinning."

Polymers can be spun into fibers having a variety of uses. In particular, liquid crystalline main chain polymers, such as poly(p-phenyleneterephthalamide), have unique physical characteristics making them useful in the production of high-strength fibers. For example, aramid fibers (fibers made from aromatic polyamides) are well known for their strength.

One method of processing linear polymers into fibers is known as dry-jet wet spinning. In this procedure a solution of the polymer, commonly referred to as a "spinning dope," is extruded from a die first through a layer of non-coagulating fluid and then into a coagulating bath. While in the coagulating bath, the solvent is removed from the dope so as to form the fiber. Tension is applied to the fiber as it leaves the coagulating bath. This stretches the fiber, which improves the degree of orientation of polymer molecules in the lengthwise direction of the fiber. While processes such as dry-jet wet spinning produce fibers having good tensile strength, they result in fiber having less than optimum tensile modulus.

In accordance with the present invention there is provided a process for making polymer fibers so as to improve their properties. Accordingly, the present invention includes a method of making a fiber comprising the sequential steps of: a) extruding as a stream a solution of a polymer having a polymer concentration of 4–24 weight % into a non-coagulating fluid; b) stretching the stream while in the non-coagulating fluid at a spinning draft of 25–2000; c) increasing the polymer concentration by at least 2 weight % to a concentration of 20–65 weight %; e) stretching the stream at a stretch ratio of 1.5–10, preferably 1.3–8; and f) increasing the polymer concentration in the stream sufficiently to form a fiber. The present invention also includes a polymer made by a claimed process as well as a polyamide fiber having a tensile strength of at least 1210 MPa and a tensile modulus of at least 145 GPa.

DESCRIPTION OF THE PREFERRED EMBODIMENTS

Figure 1:
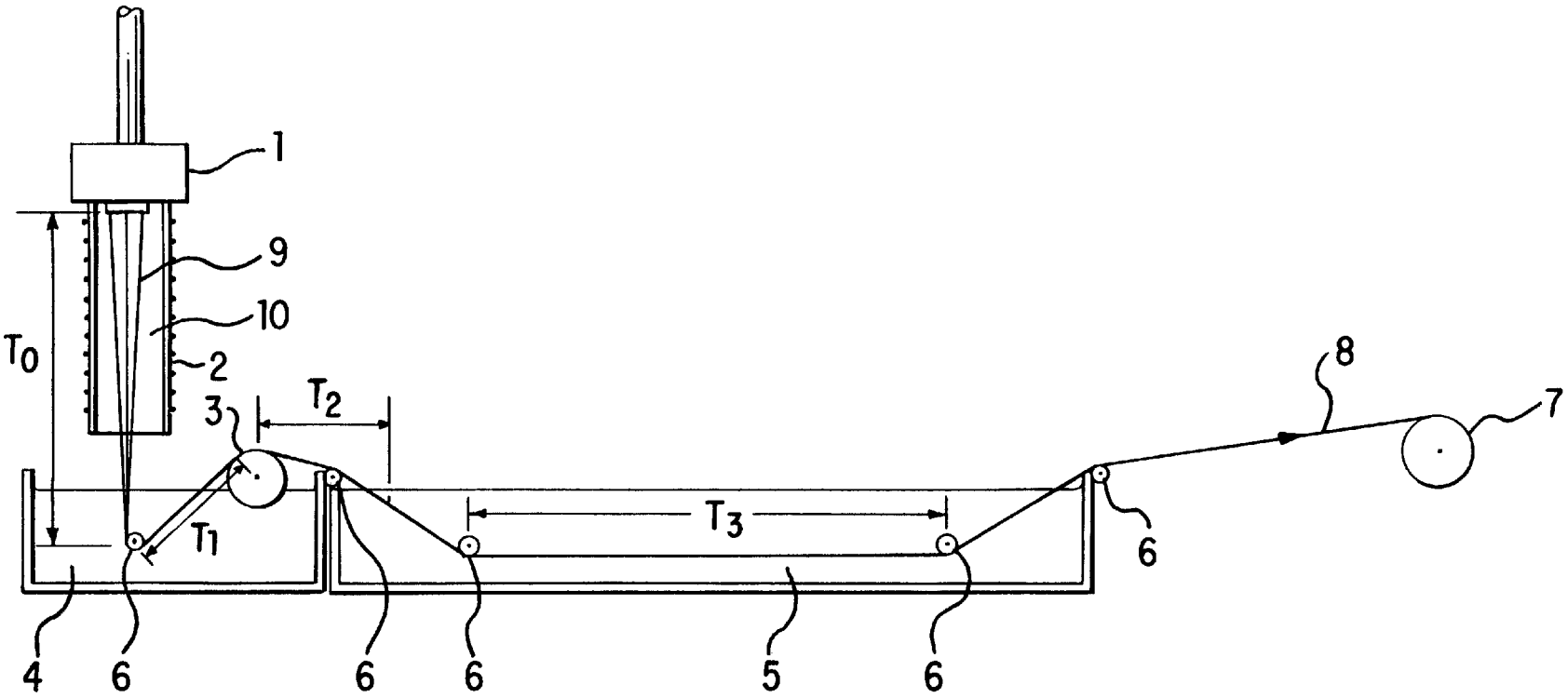
FIG. 1 is a schematic representation of an apparatus for performing a first preferred embodiment of the process of the present invention.

The method of the present invention is useful in making fibers from any polymer that is capable of forming a spinnable solution. Preferably, the polymers useful in accordance with the present invention are linear polymers, especially liquid crystalline main chain polymers. Liquid crystalline main chain polymers are well known liquid crystalline polymers (see Alger, *Polymer Science Dictionary*, Elsevier Applied Science (1989)) in which the crystalline units are part of the main polymer chain and are linked together by either rigid links, giving a rigid polymer backbone as in aromatic polyesters, aromatic polyamides, and poly-(p-phenylenebenzo-thiazole), which are known as rigid rod polymers, or flexible links, as in copolymers of ethylene-terephthalate and p-oxybenzoate. Most preferred are the rigid rod polymers. Exemplary polymers include, for example, polyolefins such as polyethylene, polypropylene, ethylene-propylene copolymers, polyoxymethylene, and polyethylene oxide, and aromatic polyamides such as disclosed in U.S. Pat. Nos. 3,414,645, 3,767,756, 4,466,935, and 4,344,908, the disclosures of which are incorporated herein by reference. Preferred polymers include the aromatic polyamides (which make fibers known as aramids), which have repeating units of the formulas —NH—R—NH—, —CO—R'—NH—, or —CO—R"—CO—, wherein R, R', and R" are optionally substituted m- or p-phenylene. Examples of useful polyamides include poly(m-phenyleneisophthalamide) (also known as MPD-I), poly(p-benzamide) (also known as PBA), poly(p-phenyleneterephthalamide), poly(p-phenylene p,p'-biphenylcarboxamide), poly(p-phenylene 1,5-naphthalenedicarboxamide), poly (trans-1,4-cinnamamide), poly (-phenylene 4,8-quinolinedicarboxamide), poly(l,4-[2,2,2]-bicyclo-octylene terephthalamide), copoly(p-phenylene 4,4'-azoxybenzene-dicarboxamide/terephthalamide), poly (p-phenylene 4,4'-trans-stilbenedicarboxamide), and poly(p-phenylene acetylenedicarboxamide). Other useful polymers include polybenzazoles, which have repeating units of the formulas:

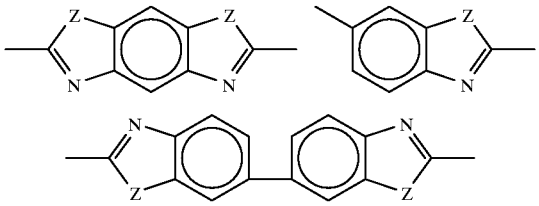

wherein Z is a sulfur atom (known as polybenzothiazoles) or an oxygen atom (known as polybenzoxazoles). Polymers comprising isomers of the repeating units of the foregoing formulas are also useful, such as poly(benzo[1,2-d: 4,5-d'] bisthiazole-2,6-diyl-1,4-phenylene) (known as trans-PBT) and poly(2,5-benzoxazole) (known as 2,5-PBO). Exemplary polybenzazoles include homopolymers such as poly(benzo [1,2-d: 5,4-d']bisazole-2,6-diyl) (known as cis-PBZ), poly (2,6-benzazole) (known as 2,6-PBZ), and poly(6,6'-bibenzazole-2,2'-diyl (known as 2,2'-PBZ). Useful polymers also include copolymers of aromatic polyamides and polybenzazoles, such as poly(p-phenylene benzobisthiazole).

Solvents in which to dissolve the polymers so as to form spinnable solutions as well as methods of forming the spinning dope are well known, such as disclosed in the aforesaid U.S. Pat. No. 3,767,756. Examples include sulfuric acid, chlorosulfuric acid, fluorosulfuric acid, poly (phosphoric acid), and mixtures thereof. In general, the concentration of the polymer in the spinning dope is 4–24 weight %, preferably 6–22 weight %. For particular polymers, polymer concentration will be governed to some extent by the viscosity requirements for forming a spinnable solution, as will be readily apparent to those of ordinary skill in the art. Techniques for preparing spinning dopes at the appropriate viscosities as well as spinning techniques useful in accordance with the present invention are also well known, such as disclosed in the aforesaid U.S. Pat. No. 3,767,756.

The present invention will now be described in detail with reference to the accompanying FIG. 1, demonstrating a first preferred embodiment of the present invention. As shown in FIG. 1, the spinning apparatus includes spinning head 1, spinning tube 2, first coagulating bath 4, freely turning guide rollers 6, heated drafting roller 3, coagulating bath 5, and stretching roller 7. In operation, spinning head 1 extrudes polymer stream 9 into first non-coagulating fluid 10 contained in spinning tube 2. The stream then passes over freely turning roller 6 in first coagulating bath 4 after which the stream is taken up by drafting roller 3. The stream then passes through second coagulating bath 5 over freely turning rollers 6 and is then wound as a fiber 8 on stretching roller 7.

The temperature at which the polymer solution is spun is sufficiently high to maintain the dope in a liquid state without degrading the polymer. Preferably, the polymer solution is spun at a spinning-head temperature of 70–100° C., more preferably 70–90° C. The temperature of the non-coagulating fluid 10 and the distance in the non-coagulating fluid through which the stream 9 passes are determined so that sufficient stretching of the stream in its longitudinal direction occurs while the stream is in the non-coagulating fluid. This stretching is important to ensure that the polymer molecules in the stream are properly oriented. Accordingly, the temperature must be sufficiently warm so that the polymer molecules can reorient themselves freely within the stream. Preferably this temperature is 40–110° C., more preferably, 40–100° C., most preferably 60–95° C. The distance that the polymer stream is in the first non-coagulating fluid depends on the initial diameter of the stream, that is, the diameter of the spinning orifice. The larger the spinning orifice the longer the distance needed to stretch the stream to a sufficient extent to reorient the polymer molecules. Preferably, the distance is 5–50 cm, more preferably 15–35 cm, most preferably 10–35 cm. Useful non-coagulating fluids are air, toluene, or heptane. Other useful non-coagulating fluids will be readily apparent to the skilled artisan. Preferably, the non-coagulating fluid is introduced at the bottom of spinning tube 2 so as to flow upward in the tube and then exit the spinning tube through appropriate apertures in the top of the spinning tube. This type of circulation is preferred in order to help prevent saturation of the non-coagulating fluid with solvent vapors.

In the first coagulating bath 4, solvent is removed from the stream 9 to increase the concentration of the polymer in the stream by at least 2 weight %, preferably by at least 10 weight %, to obtain a concentration of 15–70 weight %, preferably 30–40 weight %, in the polymer stream. Accordingly, the material in the first coagulating bath is any material known for use in coagulating baths, such as disclosed in the aforesaid U.S. Pat. No. 3,767,756. The temperature of the first coagulating bath and the distance through which the stream travels therein must be sufficient to effect the necessary polymer concentration. The preferred temperature of the first coagulating bath is 5–80° C. The distance through which the stream passes in the first coagulating bath must also be sufficient to effect the needed polymer concentration at the temperature of the bath, in general, streams of larger diameter needing longer distances.

Variables such as the size of the extrusion orifice in the spinning head 1, the extrusion rate of the spinning head, and the speed of the drafting wheel 3 are determined to ensure a sufficient stretch in the stream 9, particularly while the stream is in the non-coagulating fluid 10. Accordingly, these variables are adjusted so that a spinning draft of 25–2000, preferably 100–2000, most preferably 150–250 is achieved. The "spinning draft" is the ratio of the velocity of the polymer stream after it leaves the first coagulating bath, which in the preferred embodiment is the same as the speed of the roller 3, to the extrusion velocity $V_0$ of the stream at the spinning head. Extrusion velocity $V_0$ is calculated according to the equation $V_0=4Q/\pi R^2$, where Q is the amount of the stream passing through the spinning head per unit time (extrusion rate) and R is the diameter of the spinning orifice. Preferably, the size of the spinning head orifice through which the dope is extruded is 0.3–4 mm, more preferably 0.5–1 mm. Extrusion rates preferably vary from 0.1–3 g/min, more preferably 0.25–1.5 g/min. In accordance with these parameters, the speed of the heated roller 3 is adjusted to effect the desired spinning draft. Other means for effecting the spinning draft will be readily apparent to the skilled artisan.

After the concentration in the stream 9 is increased in accordance with the present invention in the first coagulating bath 4, it is necessary to additionally stretch the stream in order to more fully orient the polymer molecules in the stream in the desired direction before the stream is formed into the fiber 8 in the second coagulating bath 5. Since the stream 9 was cooled considerably in the first coagulating bath 4 in accordance with the preferred embodiment, it is preferable to raise the temperature of the stream sufficiently to enable the polymer molecules to be oriented within the stream during this additional stretching. In the presently disclosed embodiment, this is accomplished by heated drafting roller 3, which preferably raises the temperature of the stream to 15–80° C., more preferably 20–60° C. and, in some instances, 20—40° C. However, other means for raising the temperature of the stream will be readily apparent to the skilled artisan. If the temperature of the first coagulating bath is higher than 15° C., it is not absolutely necessary to raise the temperature of the stream for the second stretching, although an increase by at least 5° C. might be advantageous in some instances to permit a greater stretch.

In the first embodiment, after the first coagulating bath, additional stretching is applied to the stream while in a second-non-coagulating fluid (in the present embodiment air, but other non-coagulating fluids are contemplated such as disclosed above for the first non-coagulating fluid) by adjusting the stretching roller 7 to a speed faster than that of heated drafting roller 3. This makes the speed of the fiber 8 at the roller 7 greater than the speed of the stream 9 at the roller 3, which stretches the stream, particularly in the area between the roller 3 and the second coagulating bath 5, that is, while the stream is in the second non-coagulating fluid. Accordingly, the speed of the stretching roller 7 is adjusted to effect a stretch ratio of 1.3–8, more preferably 1.5–3. Other means for stretching the stream to effect the desired stretch ration will be readily apparent to the skilled artisan.

After passing over heated roller, the stream 9 then passes over freely turning guide roller 6 into second coagulating bath 5. Second coagulating bath is for the purpose of removing the remaining solvent from the stream and forming the fiber 8, a fiber being formed when the concentration of the polymer in the material is at least 85 weight %, preferably 85–98 weight %. The forming of fibers using such coagulating baths is well known, such as disclosed in the aforesaid U.S. Pat No. 3,767,756. Accordingly, parameters of the second coagulating bath, such as composition and dipping length, will be readily apparent to the skilled artisan. For example, both organic and aqueous fluids, such as methanol, methylene chloride, as well as aqueous solutions of sulfuric acid or ammonium hydroxide, are useful. The dipping time in the second coagulating bath must be sufficient to effect the desired polymer concentration. Preferably, the dipping time is 1–10 seconds, more preferably 1–5 seconds. The temperature of the second coagulating bath is preferably 5–80° C., more preferably 20–75° C. Higher temperatures within this range will effect additional stretch of the fiber and will aid in washing out of residual solvent at the end of the bath. After coagulation, the formed fiber can be washed, for example, in a 75° C. hot water bath or spray, to remove additional solvent or otherwise treated, for example by further stretching, in accordance with known procedures. Also, it is preferred that the fiber is heat treated in accordance with known procedures, such as disclosed in the aforesaid U.S. Pat. No. 3,767,756. Preferably, heat treatment is performed by heating the fiber as it passes between a feed roll and take-up roll. Preferably, heat treatment is carried out at between a 15% stretch (speed of take-up roll 15% faster than speed of feed roll) and 10% shrinkage (speed of take-up roll 10% slower than speed of feed roll), more preferably between 3% stretch and 5% shrinkage, most preferably 0% shrinkage (speed of take-up roll and feed roll the same).

In accordance with the present invention, stretching the fiber 3% or 15% during heat treatment results in a fiber having higher tensile modulus than if heat treated at 9%, but tensile strength at 3% or 15% stretch is lower than at 0%. For fiber heat-treated and shrunk at 5%, the tensile modulus is lower than 0%, but tensile strength is greater. Accordingly, heat treatment is preferably carried out in accordance with the present invention at 450–600° C., more preferably 550–600° C., for 1–10 seconds, more preferably 2–5 seconds. Heat-treated rigid-rod polymer fibers made in accordance with the present invention exhibit improved tensile modulus when compared with the same heat-treated fibers made by prior art processes.

In accordance with the first preferred embodiment of the present invention as disclosed hereinabove, there are several tension zones, $T_0$, $T_1$, $T_2$, and $T_3$, as shown in FIG. 1. In general, when the variables are adjusted in accordance with the present invention, the relative tension T effected in the stream in the zones follows the formula $T_3 \geqq T_2 >> T_1 \geqq T_0$.

Figure 2:
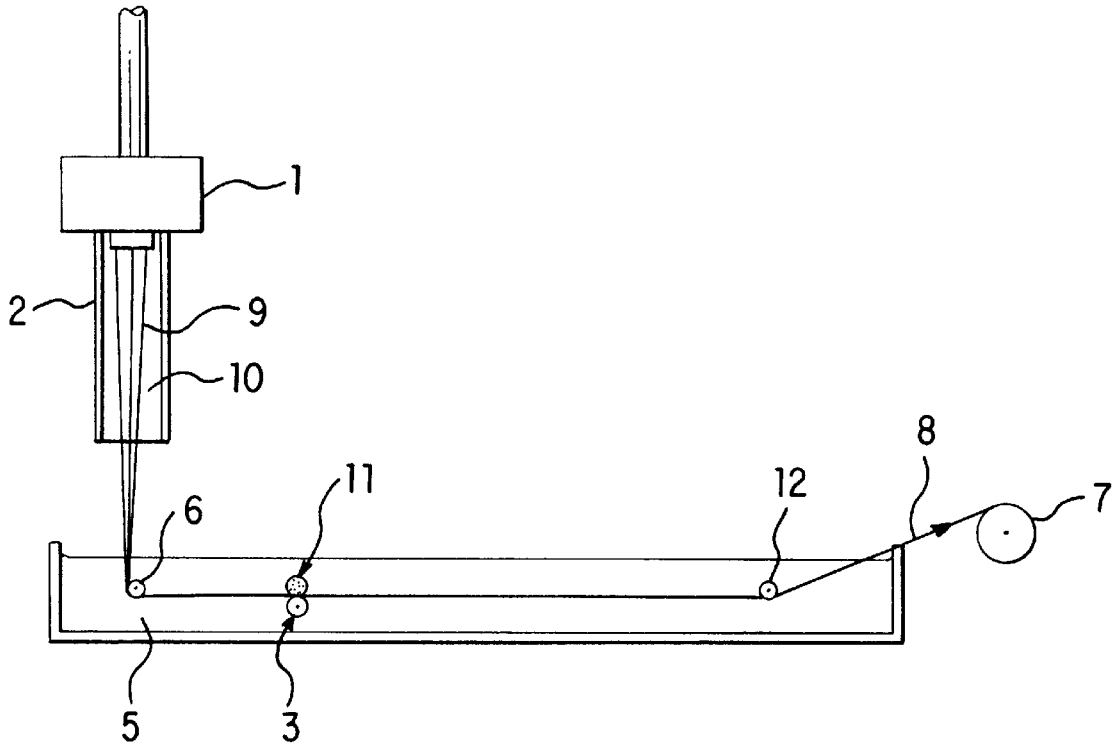
FIG. 2 is a schematic representation of an apparatus for performing a second preferred embodiment of the process of the present invention.

A second preferred embodiment is shown in accompanying FIG. 2. As shown in FIG. 2, the spinning apparatus includes spinning head 1, spinning tube 2, second coagulating bath 5, freely turning guide rollers 6 and 12, drafting roller 3, press roller 11, and stretching roller 7. In operation, spinning head 1 extrudes polymer stream 9 into non-coagulating fluid 10 contained in spinning tube 2. The stream then pass over freely turning roller 6 in coagulating bath 5 after which the stream passes between cooperating drafting roller 3 and press roller 11. The stream then passes through coagulating bath 5 over freely turning roller 12 and is then wound as a fiber 8 on stretching roller 7. Press roller 11 and drafting roller 3 cooperate in such a manner as to control the speed of the stream passing therebetween. In this way, the proper spinning draft is achieved. The distance between the roller 6 and drafting roller 3 is adjusted so that the proper concentration of the polymer in the stream is achieved in order that the stretch that is imparted to the stream after passing between rollers 3 and 11 occurs at the proper polymer concentration. That is, the concentration is increased by at least 2 weight %, preferably by at least 10 weight %, to obtain a polymer concentration of 15–70 weight %, preferably 30–40 weight %, in the polymer stream. The speed of stretching roller 7 is adjusted with relation to the speed of cooperating rollers 3 and 11 in order to effect the proper stretch ratio. That is, the speed of the stretching roller 7 is adjusted to effect a stretch ratio of 1.3–8, more preferably 1.5–3. The temperature of the coagulating bath 5 in the second preferred embodiment, as well as its composition, can be the same as that for the second coagulating bath in the first preferred embodiment. Other variables and conditions can be the same as disclosed for the first preferred embodiment.

Figure 9:
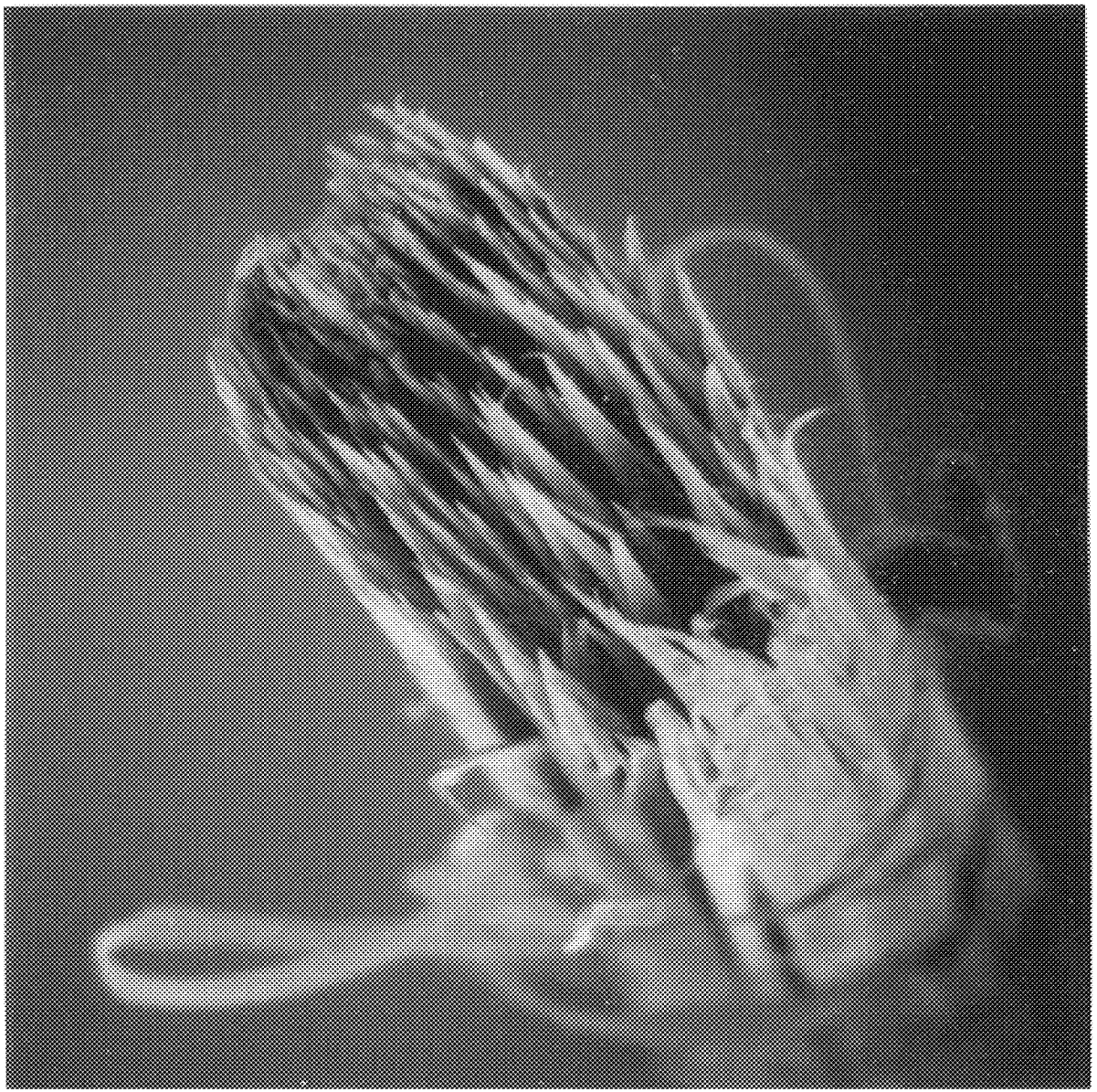
FIG. 9 is a scanning electron micrograph of the broken end of a fiber made according to the present invention (700 ×)
Figure 10:
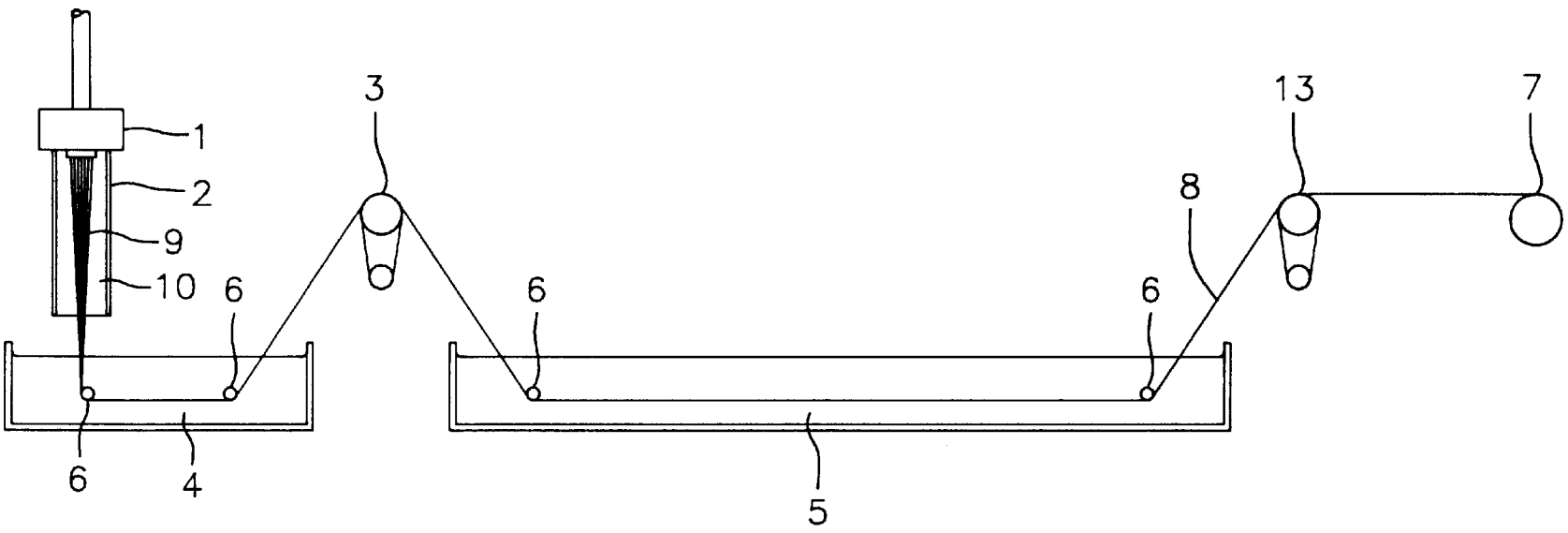
FIG. 10 is a schematic representation of an apparatus for performing a third preferred embodiment of the process according to the present invention.

FIG. 9 is an electron micrograph of a broken end of a poly(p-phenyleneterephthalamide) fiber made in accordance with the present invention. As demonstrated in FIG. 9, the individual fibrils that make up the fiber are all arranged in the longitudinal direction of the fiber. Also, as observed in FIG. 9, when the fiber is broken the individual fibrils do not split longitudinally. This is believed due to the existence of an increased number of tying molecules between the individual fibril strands, which is believed to improve the modulus of the fiber.

Figure 11:
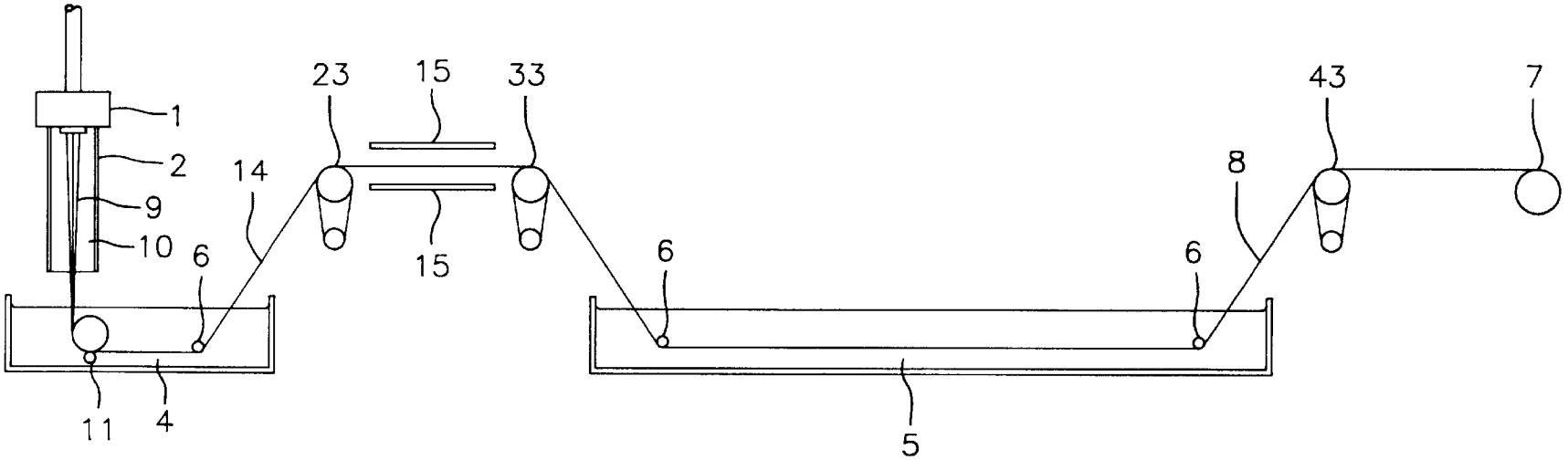
FIG. 11 is a schematic representation of an apparatus for performing a fourth preferred embodiment of the process of the present invention.
Figure 12:
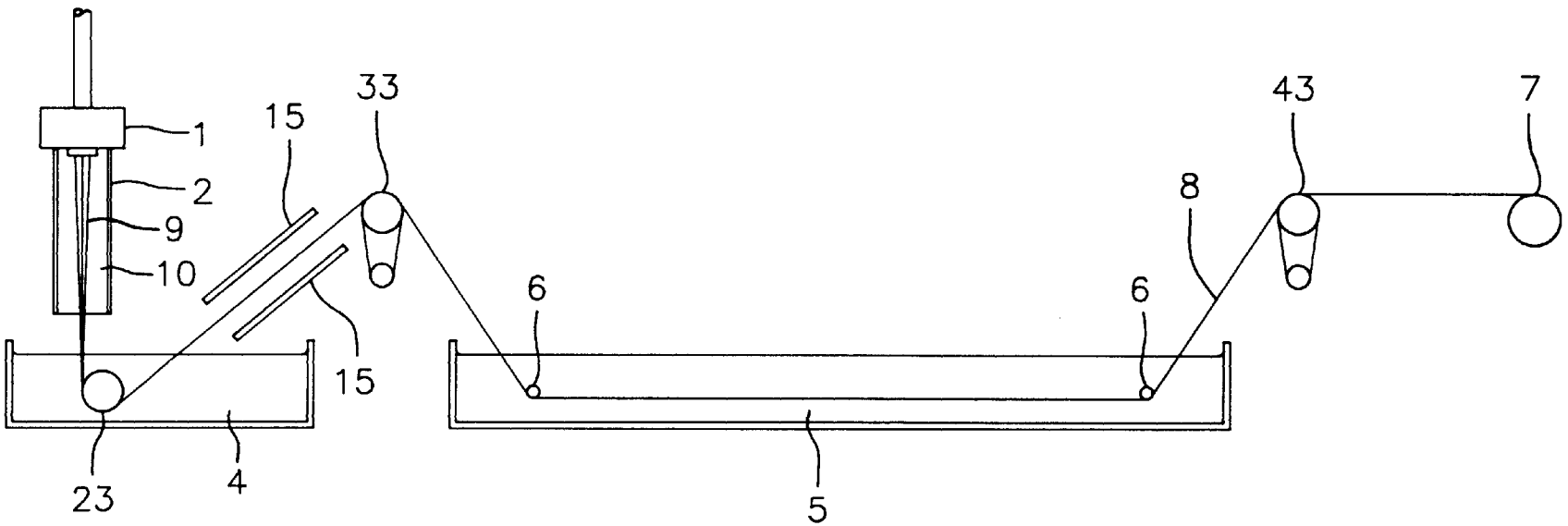
FIG. 12 is a schematic representation of an apparatus for performing a fifth preferred embodiment of the process according to the present invention.
Figure 13:
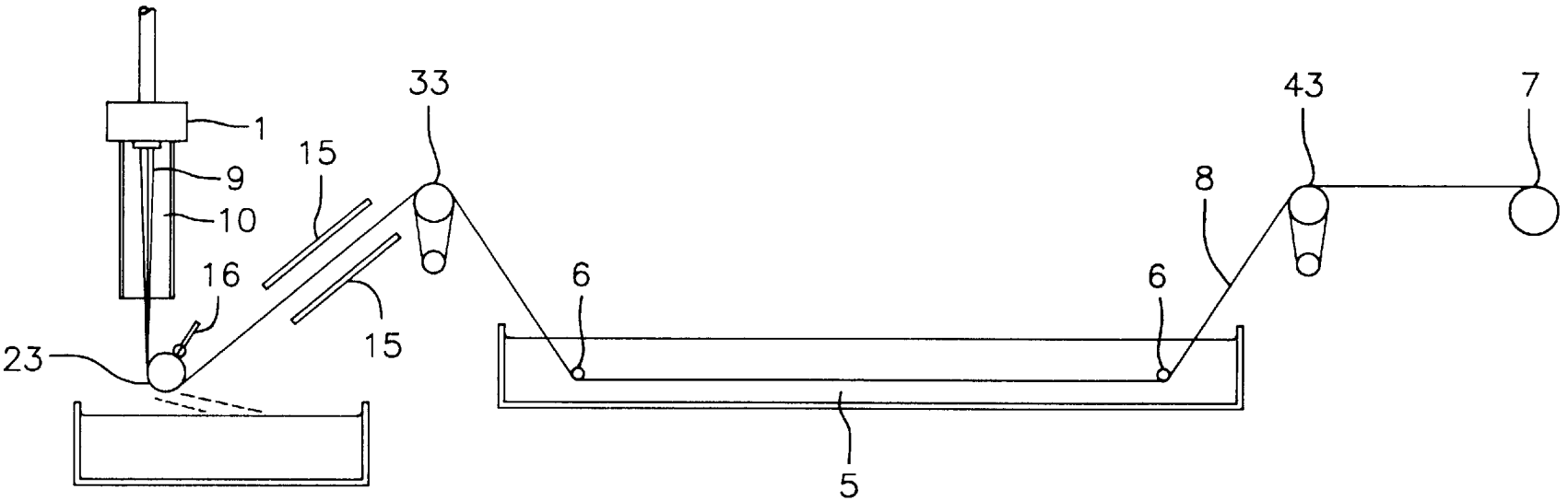
FIG. 13 is a schematic representation of an apparatus for performing a sixth preferred embodiment of the process of the present invention.

FIGS. 11, 12, and 13 represent various embodiments, which improve the uniformity of the fibers thus produced by incorporating a press roller 11 in cooperation with driven roller 13. By separating filament stretching from the final filament coagulation, as exemplified in FIGS. 11, 12, and 13, fiber strength and modulus are improved. In the embodiment of FIG. 1, the polymer filament proceeds through the quasi-coagulating bath guided by free rollers 6 where the filament shrinks giving additional stretch to the filament between the nozzle 1 and the first free roller 6. As shown in FIG. 11, the first free roller 6 in the quasi-coagulating bath 4 is replaced by a combination of driven roller 13 and pressing roller 11, which avoids friction fluctuations that may be caused by the first free roller 6 seen in FIG. 1. Avoiding friction fluctuations avoids draft (stretch) fluctuations caused thereby, effecting a more uniform fiber. Also, whereas the embodiment in FIG. 1 involves stretching in the coagulating bath 5, the embodiment in FIG. 11 separates the stretch process from the coagulating bath 5 by completing the stretch at the quasi-coagulation stage. Allowing very little, or no, stretch in the final coagulating bath (by previously completing stretching) reduces shrinkage of the fiber in the bath. Shrinkage in the bath decreases molecular orientation in the fiber, with a resulting decrease in fiber strength and modulus.

In the FIG. 11 embodiment, the quasi-coagulated filament 14 is stretched at a preferred stretch ratio of 1.3–8 between driven rollers 23 and 33. The temperature between rollers 23 and 33 is adjusted to 0–9° C., preferably 20–60° C., by heater 15, at least 5° C. greater than the temperature of the first coagulating bath, optimally varied depending on the polymer concentration in the quasi-coagulated filament.

Therefore, reducing fiber stretch in the bath increases fiber strength and modulus. For example, at a polymer concentration in the quasi-coagulated filament of about 30–40 weight %, the preferred temperature range is 0–70° C., whereas, at a 50–60 weight % concentration, the preferred temperature is 0–90° C. Following stretching, the filament is coagulated between driver rollers 33 and 43, passing through coagulating bath 5 over free rollers 6. Preferably, the polymer concentration in filament 14 entering coagulating bath 5 is 25–40% and the relative speeds of rollers 43/33 (ratio $R_3/R_2$) is 0.8–1.2, more preferably 0.9–1.2, most preferably 1.0–1.1. Optimum tension in coagulating bath 5 depends on the orientation of the polymer molecules in the filament produced by the stretch between driven rollers 23 and 33. During stretch between rollers 23 and 33, polymer concentration in the filament remains constant (for example 30%), the filament is still soft, deformation is easy, and stretch is effective to obtain a high molecular orientation. During stretch between roller 33 and 43, polymer concentration is increasing all the way. As the polymer concentration increases to 50–60%, molecular orientation may still increase. But, at 70% or more, molecular orientation is almost frozen. Even though molecular orientation no longer increases, fiber properties improve under high-tension coagulation. During final coagulation, the filament shrinks if the filament tension is too low. That is, orientation of molecules is decreasing all the way through the final coagulating bath until the filament reaches complete coagulation. When filament tension in the final coagulating bath is sufficiently high, even without stretch in the bath ($R_3/R_2$=1), molecular orientation is increased due to volume decrease of the filament during coagulation.

FIGS. 12 and 13 represent variations on the concept shown in FIG. 11. In FIG. 12, rather than include a press roller in opposition to the driven roller in the quasi-coagulation bath, the spun fiber is wound at least one turn around roller 23 in quasi-coagulation bath 4 followed by passing through air heated by heater 15 after it leaves the quasi-coagulation bath 4, followed by passing over driven roller 33 and then into coagulation bath 5 and then over driven roller 43. Preferred roller speeds, heater temperature and polymer concentration in filament entering coagulating bath are the same as in FIG. 11. The polymer concentration in the quasi-coagulated filament 14 depends on dipping time, filament diameter, and the temperature in the quasi-coagulating bath. The following table illustrates the variation in polymer concentration as a function of dipping, where the starting filament diameter is 62$\mu$, and the quasi-coagulating-bath temperature 5° C.

| Dipping time (sec.)[1] | 1 | 2 | 3 | 4 | 5 |
|---|---|---|---|---|---|
| Polymer concentration after quasi-coagulation by weight %[2] | 12 | 18 | 26 | 34 | 36 |

[1]Calculated as dipping length/speed of roller 23. Difference with the actual dipping time is negligible because of filament shrinkage that occurs in the quasi-coagulating bath.
[2]Starting polymer concentration is 7% by weight.

FIG. 13 is a variation of FIG. 12 wherein the coagulation bath 4 is replaced by a water shower effected by shower nozzle 16, by which water is sprayed on the roller 23. In FIGS. 12 and 13, polymer concentration in the filament is controlled by either dipping time in the quasi-coagulation bath 4 or resident time on the roller 23. In situations where the speed of driven roller 23 is high, that is, greater than 20 m/min., use of sulfuric acid in either the shower or quasi-coagulation bath is preferred, for example, a 60% sulfuric acid solution effects a 40% polymer concentration in the filament. Preferably, the concentration of sulfuric acid (in the water bath) is 50–85 weight %, more preferably 60–70 weight %.

The foregoing descriptions of preferred embodiments are provided by way of illustration. The practice of the present invention is not limited thereto and variations therefrom will be readily apparent to the skilled artisan without deviating from the spirit of the present invention.

The following, non-limiting examples are provided to further illustrate the present invention. All parts and percentages in the examples are by weight unless indicated otherwise.

EXAMPLES 1–6

Fibers are prepared from a high molecular weight rigid-rod polymer in accordance with the present invention at various stretching concentrations (that is, concentration of polymer after leaving the first coagulating bath). Using the apparatus described in FIG. 1, the following conditions are employed; spinning solution is poly(p-phenyleneterephthalamide) having an inherent viscosity of 5.2 (obtained from AKZO, Netherlands) dissolved in 99.5% $H_2SO_4$ at a concentration of 7 weight %, extrusion rate is 0.1 g/min.; spinning-nozzle orifice diameter is 1 mm; spinning tube-length is 7 cm; temperature of spinning solution, nozzle temperature, and spinning tube temperature are 80° C.; first coagulating bath is water at a temperature of 5° C.; temperature of heated drafting roller is 20° C.; the second coagulating bath is water at a temperature of 20° C.; spinning draft is 150. The dipping length in the first coagulating bath is adjusted between 17–70 cm in order to achieve the desired stretching concentration. The dipping length in the second coagulating bath is accordingly adjusted between 30–90 cm to obtain a fiber from the polymer stream. The stretch ratio is adjusted to 0.5×maximum stretch ratio. The "maximum stretch ratio" is determined by passing the stream immediately from the drafting roller to the stretching roller and increasing the speed of the stretching roller until the fiber breaks. The resulting polymer concentrations are reported in the following Table 1.

TABLE 1

| Example | Polymer Concentration (%) | Dipping Length[1] (cm) | Stretch Ratio | Dipping Length[2] (cm) |
|---|---|---|---|---|
| 1 | 12 | 17 | 1.65 | 55 |
| 2 | 24 | 26 | 1.8 | 50 |
| 3 | 33 | 36 | 1.8 | 50 |
| 4 | 41 | 44 | 1.7 | 45 |
| 5 | 47 | 53 | 1.5 | 45 |
| 6 | 56 | 70 | 1.3 | 40 |

[1]First coagulating bath.
[2]Second coagulating bath.

Following the second coagulating bath the fiber is washed with a hot-water spray (75° C.) to remove residual acid. The final fiber is then heat treated at 0% shrinkage and 550° C. for 5 seconds. The fibers are tested for tensile modulus and tensile strength in accordance with ASTM Method D 3379–75 (1975), and % elongation is the difference between the fiber length at breakage and the original length divided by the original length. The results are recorded in the following Table 2.

TABLE 2

| Example | Denier | Tensile Strength MPa | Tensile modulus GPa | % elongation |
|---|---|---|---|---|
| 1 | 3.7 | 2850 | 240 | 2.0 |
| 2 | 3.3 | 3270 | 340 | 1.6 |
| 3 | 3.3 | 3420 | 390 | 1.4 |
| 4 | 3.5 | 3320 | 420 | 1.4 |
| 5 | 3.6 | 3180 | 416 | 1.4 |
| 6 | 4.4 | 2840 | 383 | 1.5 |

Examples 1–6 are repeated with results as reported in the following table.

TABLE 2a

| Example | Denier | Tensile Strength MPa | Tensile modulus GPa | % elongation |
|---|---|---|---|---|
| 1A | 3.7 | 2850 | 167 | 1.7 |
| 2A | 3.3 | 3270 | 251 | 1.3 |
| 3A | 3.3 | 3420 | 310 | 1.1 |
| 4A | 3.5 | 3320 | 301 | 1.1 |
| 5A | 3.6 | 3180 | 289 | 1.1 |
| 6A | 4.4 | 2840 | 236 | 1.2 |

As demonstrated in Tables 2 and 2A, the fibers made according to the present invention have an excellent balance of tensile strength and tensile modulus.

EXAMPLES 7–12

A series of fibers are made by redissolving an aramid fiber (KEVLAR 29 available from E.I. du Pont de Nemours Co.) in 95% $H_2SO_4$ and spinning the resulting solution to make fibers in accordance with the present invention at various stretching concentrations. Conditions followed are as in Examples 1–6 except as modified below. As in Examples 1–6, stretching concentration is varied by varying the dipping length of the stream in the first coagulating bath between 5–40 cm, and the dipping length in the second coagulating bath is accordingly adjusted such that the final fibers have the same polymer concentration and roughly similar denier. Conditions are recorded in the following Table 3.

TABLE 3

| Example | Polymer Concentration % | Dip Length[1] cm | Stretch Ratio | Dipping Length[2] cm |
|---|---|---|---|---|
| 7 | 11 | 5 | 1.8 | 60 |
| 8 | 17 | 12 | 2.1 | 55 |
| 9 | 27 | 23 | 2.4 | 50 |
| 10 | 36 | 35 | 2.2 | 50 |
| 11 | 44 | 45 | 1.9 | 45 |
| 12 | 52 | 60 | 1.6 | 45 |

[1]First coagulating bath.
[2]Second coagulating bath.

The fibers are tested for tensile modulus and tensile strength in accordance with ASTM Method D 3379-75 (1975). The results are recorded in the following Table 4.

TABLE 4

| Example | Denier | Tensile Strength MPa | Tensile modulus GPa | % elongation |
|---|---|---|---|---|
| 7 | 3.3 | 2780 | 115 | 2.4 |
| 8 | 2.8 | 2940 | 140 | 2.1 |
| 9 | 2.5 | 2980 | 186 | 1.6 |
| 10 | 2.7 | 2810 | 234 | 1.2 |
| 11 | 3.1 | 2520 | 210 | 1.2 |
| 12 | 3.7 | 2140 | 194 | 1.1 |

As in Examples 1–6, the fibers made in accordance with the present invention have an excellent balance of tensile strength and tensile modulus.

EXAMPLE 13

Figure 4:
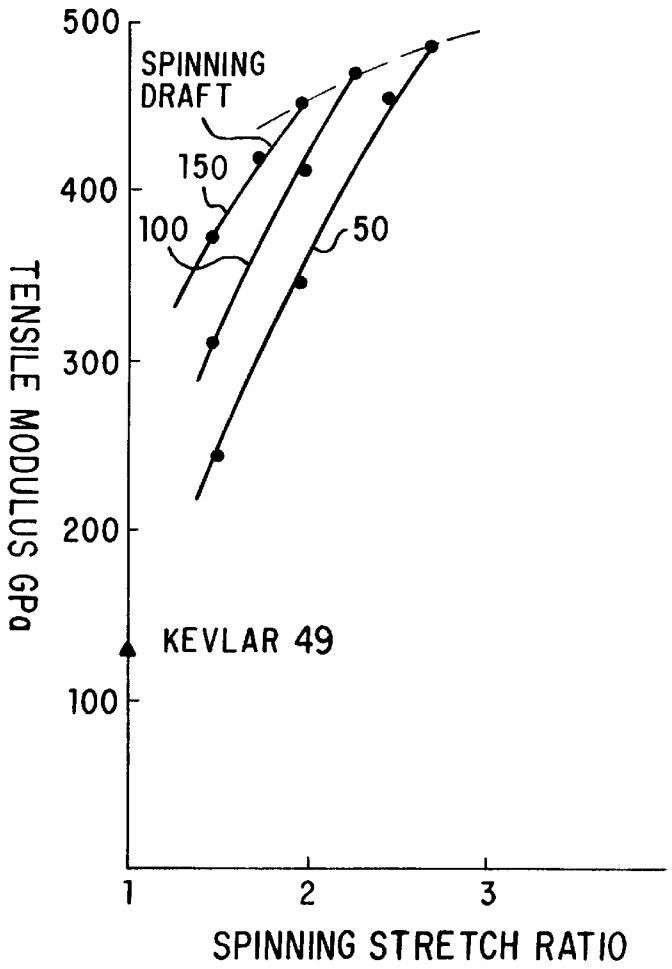
FIG. 4 is a graph plotting the tensile modulus as a function of spinning draft and stretch ratio for various fiber samples.
Figure 3:
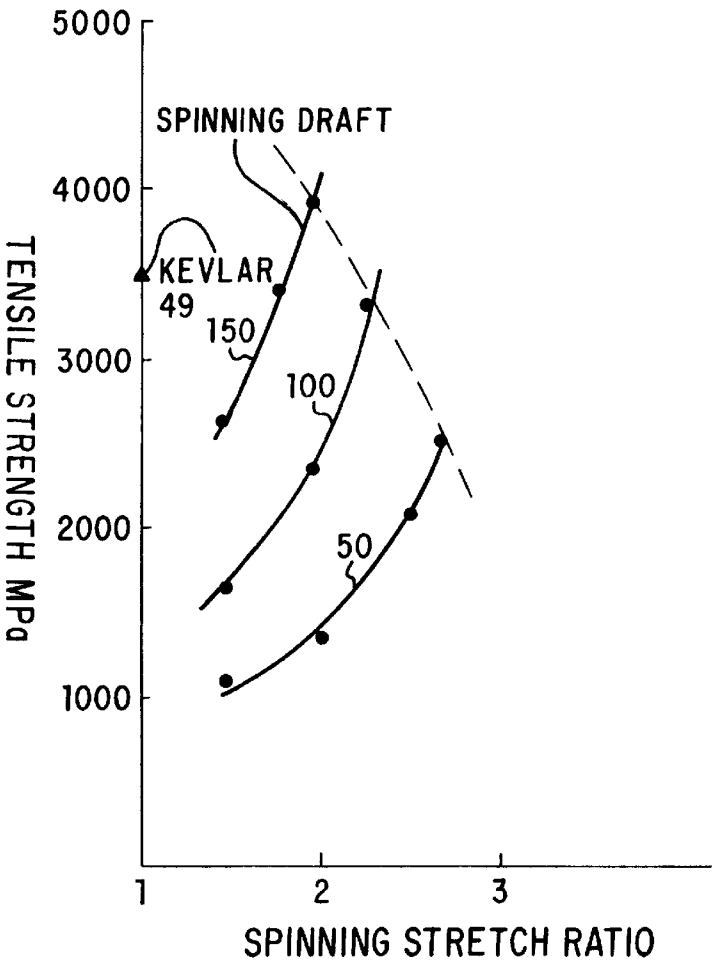
FIG. 3 is a graph plotting the tensile strength as a function of spinning draft and stretch ratio for various fiber samples.

Samples of fiber are made in accordance with the present invention at different spinning drafts. Spinning conditions, using the apparatus described hereinabove, are follows; spinning solution is poly(p-phenyleneterephthalamide) (as in Examples 1–6) dissolved in 99.5% $H_2sO_4$; concentration of polymer in spinning solution is 20%; temperature of spinning solution, spinning nozzle, and spinning tube are 85° C.; nozzle-orifice diameter is 1 mm; extrusion rate is 0.15 g/min; spinning tube length is 7 cm; first coagulating bath is water at a temperature of 5° C.; dipping length in first coagulating bath is 5 cm; polymer concentration at drafting roller is 40%; temperature of drafting roller is 20° C.; second coagulating bath is water at a temperature of 20° C.; dipping length in the second coagulating bath is 60 cm. For each of three spinning drafts (50, 100, 150), samples are made using various stretch ratios. For each sample, tensile strength and tensile modulus are determined as in Examples 1–6. The various stretch ratios and results are recorded in FIGS. 3 and 4. As seen in FIG. 3, the fiber of spinning draft 150 and stretch ratio 1.8 (maximum stretch ratio ×0.6 for spinning draft 150) has a higher tensile strength than the fiber of spinning draft 50 and stretch ratio 2.7 (maximum stretch ratio for spinning draft 50). As seen in FIG. 4, the tensile modulus of low draft/high stretched fiber is higher than for high draft/low stretched fiber; but, the difference is not as marked as in tensile strength.

EXAMPLE 14

Figure 6:
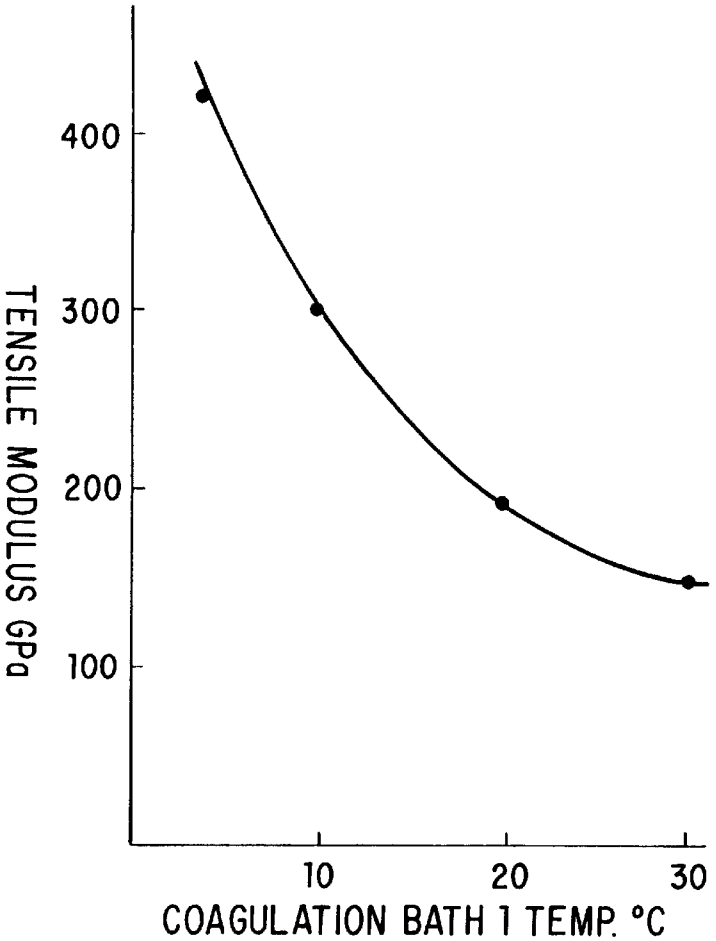
FIG. 6 is a graph plotting the tensile modulus as a function of the temperature of the first coagulating bath for various fibers.
Figure 5:
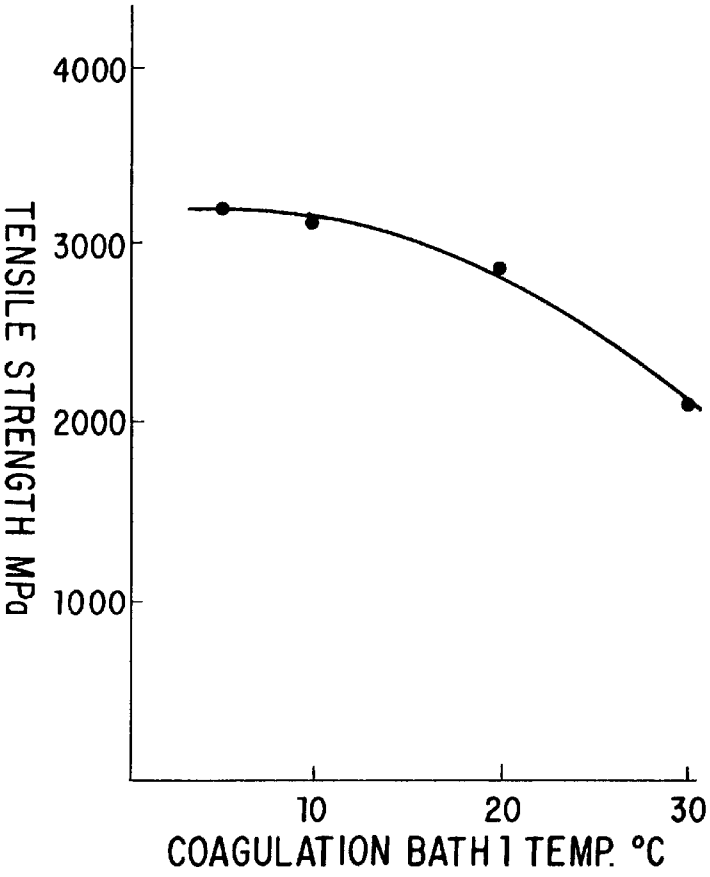
FIG. 5 is a graph plotting the tensile strength as a function of the temperature of the first coagulating bath for various fibers.

Samples of fiber are made in accordance with the present invention using different first-coagulating-bath temperatures. Using the apparatus described hereinabove, spinning conditions are as follows: spinning solution is poly(p-phenyleneterephthalamide) (as in Examples 1–6) dissolved in 99.5% $H_2SO_4$; concentration of polymer in spinning solution is 20%; temperature of spinning solution, spinning nozzle, and spinning tube are 85° C.; nozzle orifice diameter is 1 mm; extrusion rate is 0.15 g/min; spinning tube length is 7 cm; first coagulating bath is water at a temperature of 5° C.; polymer concentration at drafting roller is 40%; spinning draft is 100; temperature of drafting roller is 20° C.; second coagulating bath is water at a temperature of 20° C.; dipping length in the second coagulating bath is 60 cm; stretch ratio is 2.2. The temperature of the first coagulating bath is varied and the tensile strength and tensile modulus determined as in Examples 1–6. The various temperatures and results are recorded in FIGS. 5 and 6. As seen in the Figs., fiber properties are better at lower temperatures.

EXAMPLE 15

Figure 8:
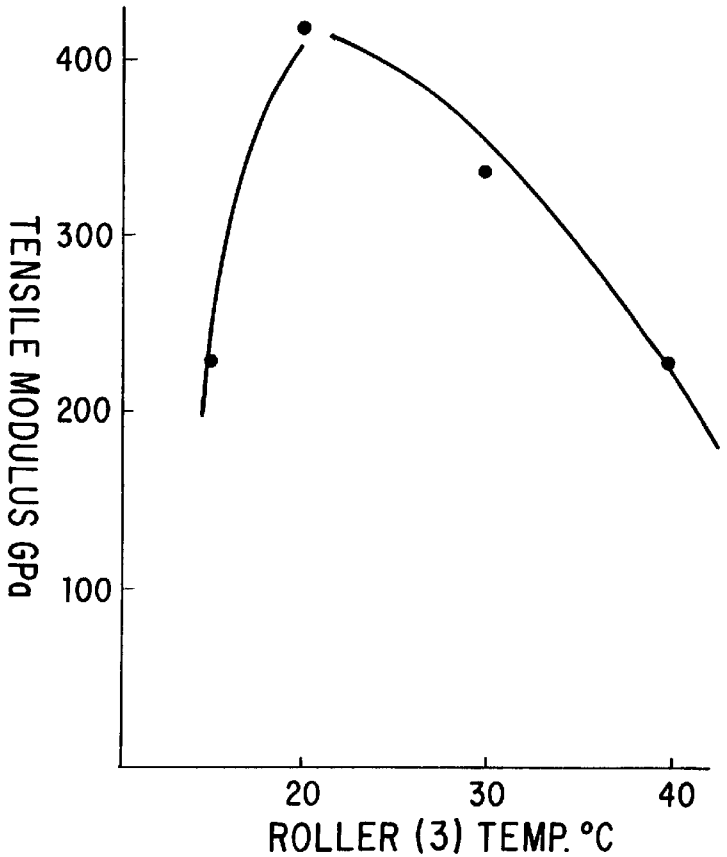
FIG. 8 is a graph plotting the tensile modulus as a function of the temperature of a drafting roller for various fibers.
Figure 7:
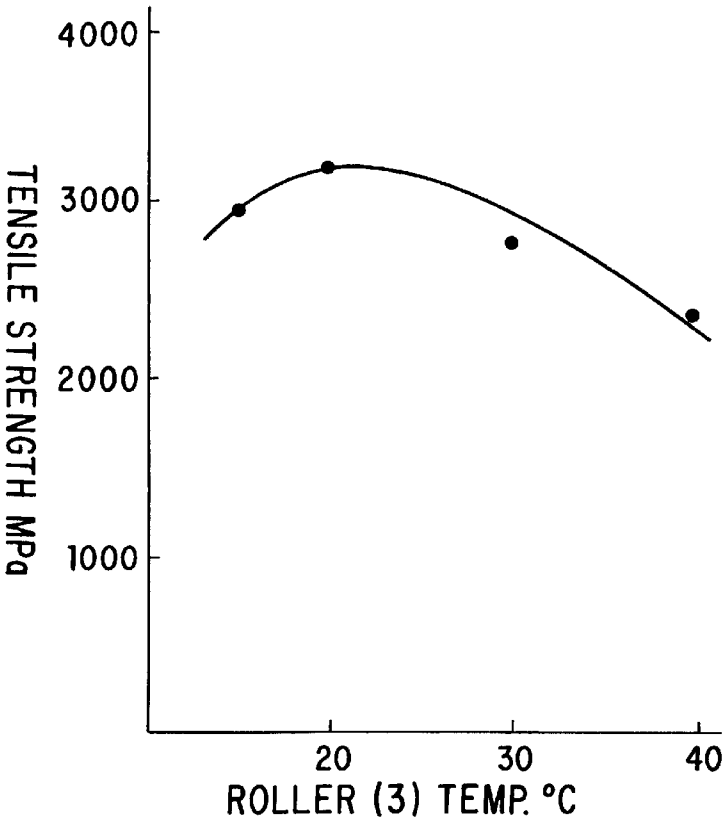
FIG. 7 is a graph plotting the tensile strength as a function of the temperature of a drafting roller for various fibers.

Samples of fiber are made in accordance with the present invention using different drafting roller temperatures. Using the apparatus described hereinabove, spinning conditions are the same as in Example 12, with the temperature of the first coagulating bath at 5° C., except that the stretch ratio is 0.5×the maximum stretch ratio, which is determined as in Examples 1–6. The temperature of the drafting roller is varied and the tensile strength and tensile modulus determined as in Examples 1–6. The various temperatures and results are recorded in FIGS. 7 and 8. As seen in the Figs., tensile modulus increases markedly as the temperature increases, then decreases sharply as the temperature is increased further. The temperature of the drafting roller has a similar effect on tensile strength; but, both the increase and decrease are not as marked.

EXAMPLE 16

Using the apparatus as shown in FIG. 11, tests are conducted to determine the effects on fiber properties of the relative speeds of driven roller 43/33 (the ratio $R_3/R_2$) as opposed to the relative speeds of driven rollers 33/23 (the ratio $R_2/R_1$). Other conditions are as described in the preceding Examples 1–6. Test results are reported in the following Table 5.

TABLE 5

Fiber Properties Based on Variations of $R_2/R_1$ and $R_3/R_2$[1]

| $R_2/R_1$ | $R_3/R_2$ 0.8 | 0.9 | 1.0 | 1.1 | 1.2 | 1.3 |
|---|---|---|---|---|---|---|
| | | Tensile Strength (MPa) | | | | |
| 1.8 | 1620 | 2720 | 3210 | 3580 | ** | ** |
| 1.4 | * | 2060 | 2620 | 3010 | 3220 | ** |
| | | Tensile Modulus (GPa) | | | | |
| 1.8 | 180 | 226 | 237 | 270 | ** | ** |
| 1.4 | * | 187 | 208 | 231 | 248 | ** |
| | | % Elongation to Rupture | | | | |
| 1.8 | 0.9 | 1.20 | 1.35 | 1.33 | ** | ** |
| 1.4 | * | 1.1 | 1.25 | 1.30 | 1.29 | ** |

[1]Stretch temperature 20° C., polymer concentration in quasicoagulated filament is 30%.
*Filament could not be passed through coagulating bath, since maximum filament shrinkage in the bath without tension is less than $R_3/R_2$.
**Filament broken.

Under the same ratio $R_2/R_1$ at the same polymer concentration in the quasi-coagulated filament, $R_2/R_3$ has a large influence on fiber properties. When $R_3/R_2$=1.2 and $R_2/R_1$=1.8, filament tension in coagulating bath 5 increases, and the filament cannot withstand the tension and breaks in the coagulating bath. At $R_2/R_1$=1.4, when $R_3/R_2$ is 0.8 (or less), filament tension in the coagulating bath becomes 0, and the filament cannot be passed through the coagulating bath. When $R_3/R_2$ passes a level sufficient to pass the filament through the coagulating bath, filament tension is produced by the resultant shrinking of the filament in the bath. Limitations on $R_3/R_2$ apparently depend on the orientation of the polymer molecules in the filament (as it leaves the driven roller 33), which is produced by the stretch between driven rollers 23 and 33. When $R_2/R_1$=1.8 and the stretch temperature is 20° C., $R_3/R_2$=0.8 is the maximum shrinkage ratio; that is, maximum filament shrinkage occurs in the final coagulation bath, and the polymer in the filament is less oriented compared with the orientation in the filament just after leaving driven roller 33. In the case of $R_2/R_1$=1.4 (medium stretch), molecular orientation in the filament at roller 33 is lower than in the case of $R_2/R_1$=1.8 (maximum stretch). At $R_2/R_1$=1.4, the maximum stretch of $R_3/R_2$ (1.2) is higher than in the case of $R_2/R_1$=1.8; however, tensile strength and modulus in the final fiber are lower in the case of $R_2/R_1$=1.4 compared with the case of $R_2/R_1$=1.8. Thus, higher molecular orientation at roller 33 effects a correspondingly higher tensile strength and modulus in the final fiber.

EXAMPLE 17

Using the apparatus as shown and described in FIG. 11, the effects on fiber properties are determined as a function of stretch temperature (as regulated by heater 15) and polymer concentration (in filament at roller 23).

Using the procedures in the previous example, the effects of heater 15 temperature are determined (polymer concentration=30%; $R_2/R_1$=1.1). Effects of the heater temperature on fiber properties are shown in the following Table 7.

TABLE 7

Stretch-Temperature Effect

| Heater temperature ° C. | 20 | 40 | 60 | 70 |
|---|---|---|---|---|
| Maximum $R_2/R_1$ | 1.8 | 2.4 | 2.6 | 2.2 |
| Tensile strength MPa | 3580 | 3690 | 3710 | 2560 |
| Tensile modulus GPa | 270 | 278 | 285 | 203 |
| Elongation | 1.33 | 1.31 | 1.30 | 1.26 |

Heater temperature of 60° C. effects maximum tensile strength and modulus. At 70° C., maximum stretch ($R_2/R_1$) obtainable decreases to 2.2, because visco-elastic value of the filament becomes too low; molecular entanglements (proportional to visco-elastic value) at stretch being too low to obtain a higher stretch. Since less stretch (less molecular orientation) is obtained, the tensile strength and modulus at 70° C. are lower than in the case of 60° C. When the procedure is repeated at a polymer concentration of 50%, optimum heater temperature is 80° C.; but, because the visco-elastic value is high, the maximum stretch ($R_2/R_1$) obtainable is 1.8, which is less than obtainable at a polymer concentration of 30% (2.6). Accordingly, tensile strength and modulus at a polymer concentration of 50% (80° C. stretch) are lower than in the case of a polymer concentration of 30% (60° C. stretch).

The results above indicate that, at a given polymer concentration, increasing stretch temperature up to a point has a positive effect on fiber properties. On the other hand, increasing the pre-stretch polymer concentration above a certain level has negative effect on fiber properties.

EXAMPLE 18

Using the procedures and optimum parameters determined in the previous Examples, fiber properties are measured as a function of coagulation tension ($R_3/R_2$) and reported in the following Table 8.

TABLE 8

| | Coagulation-Tension Effect[1] | | | | | | |
|---|---|---|---|---|---|---|---|
| | $R_3/R_2$ | | | | | | |
| | 0.7 | 0.8 | 0.9 | 1.0 | 1.025 | 1.05 | 1. |
| Tensile strength (MPa) | 1210 | 2200 | 3220 | 3710 | 3035 | 288 | |
| Tensile modulus (GPA) | 145 | 178 | 242 | 285 | 275 | 242 | |
| Elongation (%) | 0.83 | 1.23 | 1.33 | 1.30 | 1.19 | 1.1 | |

[1]Stretch temperature = 60° C., $R_2/R_1$ = 2.6, polymer concentration in guasi-coagulated filament is 30%.
*Filament broke at $R_3/R_2$ = 1.1.

The properties shown demonstrate the positive effect of providing a coagulation tension between driven rollers 33 and 43 resulting from a ratio $R_3/R_2$ of about 1.0–1.1 (representing an increase in the fiber tension over that approximately corresponding to $T_3$ in the apparatus shown in FIG. 1).

What is claimed is:

1. A process of making a fiber comprising the sequential steps of:

a) extruding a stream of a solution of a polymer having a polymer concentration of 4–24 weight % into a first non-coagulating fluid;

b) stretching the stream while in the non-coagulating fluid at a spinning draft of 25–2000;

c) passing the stream through a first coagulating bath to increase the polymer concentration by at least 2 weight % to a concentration of 20–65 weight %;

d) stretching the stream at a stretch ratio of 1.3–8 in a second non-coagulating fluid; and e) passing the stream through a second coagulating bath to sufficiently increase the polymer concentration in the stream to form the fiber.

2. The process of claim 1 wherein the polymer is a liquid crystalline main chain polymer.

3. The process of claim 2 wherein the liquid crystalline main chain polymer is a polyamide.

4. The process of claim 1 further comprising passing the stream between a first driven roller and a cooperating press roller before stretching the stream in step 5, effected by passing the stream over a second driven roller followed by a third driven roller.

5. The process of claim 4 further comprising a fourth driven roller that contacts the fiber in a manner to effect a tension ratio of 0.8–1.2 in the filament passing through the second coagulating bath.

6. The process of claim 1 wherein the stream is passed through the second coagulating bath at a tension ratio of 0.8–1.2.

7. The process of claim 1 wherein the stream is passed through the second coagulating bath at a tension ratio of 0.9–1.2.

* * * * *